US006605340B1

(12) United States Patent
Heiniger

(10) Patent No.: US 6,605,340 B1
(45) Date of Patent: Aug. 12, 2003

(54) CAMOUFLAGE STRUCTURE

(75) Inventor: Fritz Heiniger, Interlaken (CH)

(73) Assignee: Schweizerische Eidgenossenschaft, Berne (CH)

( * ) Notice: Subject to any disclaimer, the term of this patent is extended or adjusted under 35 U.S.C. 154(b) by 0 days.

(21) Appl. No.: 09/331,115

(22) PCT Filed: Feb. 2, 1998

(86) PCT No.: PCT/CH98/00038

§ 371 (c)(1),
(2), (4) Date: Jul. 7, 1999

(87) PCT Pub. No.: WO98/36234

PCT Pub. Date: Aug. 20, 1998

(30) Foreign Application Priority Data

Feb. 12, 1997 (CH) ..... 304/97

(51) Int. Cl.[7] ..... B32B 3/00

(52) U.S. Cl. ..... 428/209; 428/195; 428/919; 428/15; 428/17; 428/457; 89/36.01; 442/43; 442/44; 442/71; 442/72; 442/73; 442/74; 442/75; 442/132; 442/378; 442/379

(58) Field of Search ..... 428/919, 17, 457, 428/15, 195, 209; 89/36.01; 442/43, 44, 71, 72, 73, 74, 75, 131, 132, 376, 378, 379

(56) References Cited

U.S. PATENT DOCUMENTS

| | | | |
|---|---|---|---|
| 3,069,796 A | | 12/1962 | Rüter |
| 3,733,606 A | | 5/1973 | Johansson |
| 4,340,634 A | | 7/1982 | Pusch et al. |
| 4,464,418 A | | 8/1984 | Pusch et al. |
| 4,495,239 A | * | 1/1985 | Pusch et al. |
| 4,529,633 A | | 7/1985 | Karlsson |
| 4,879,171 A | | 11/1989 | Jeffrey |
| 5,348,789 A | | 9/1994 | Hellwig |
| 6,018,587 A | * | 1/2000 | Cabib |

FOREIGN PATENT DOCUMENTS

| | | | |
|---|---|---|---|
| DE | 725253 | | 9/1942 |
| DE | 1088843 | | 9/1960 |
| DE | 977526 | * | 11/1966 |
| DE | 2759657 | | 9/1983 |
| DE | 3614017 | | 10/1987 |
| EP | 0010568 | | 5/1980 |
| EP | 0058210 | | 8/1982 |
| EP | 0198283 | | 10/1986 |
| FR | 2716038 | | 8/1995 |
| GB | 565238 | | 11/1944 |
| GB | 1074895 | | 7/1967 |
| GB | 1605131 | * | 12/1981 |
| GB | 1605187 | * | 3/1983 |
| IL | 059771 | | 7/1982 |
| IL | 070547 | | 10/1987 |
| IL | 098430 | | 7/1996 |

* cited by examiner

*Primary Examiner*—Deborah Jones
*Assistant Examiner*—Wendy Boss
(74) *Attorney, Agent, or Firm*—Birch, Stewart, Kolasch & Birch, LLP

(57) ABSTRACT

To ensure that a camouflage structure will not lose its effectiveness even in changing temperatures (day/night, sunshine/clouds) when protecting against reconnaissance in the IR range, the camouflage structure features varying emissivity tendencies in the atmospheric windows II (3–5 um) and III (8–14 um). In other words, the emissivity in the IR range is not constant and at a certain level, but it has an increasing or decreasing tendency in at least one selected spectral range.

14 Claims, 1 Drawing Sheet

CAMOUFLAGE STRUCTURE

This application is the national phase under 35 U.S.C. §371 of PCT International Application No. PCT/CH98/00038 which has an International filing date of Feb. 2, 1998 which designated the United States of America.

BACKGROUND OF THE INVENTION

1. Field of the Invention

The invention relates to a camouflage structure which features a layer that reflects in the IR range, and to a camouflage net that is equipped with such a structure.

2. Description of Background Art

The best possible camouflage of items, installations, and even persons is a central aspect of any military defense instruction. The cardinal goal is to prevent, or at a minimum to impede, reconnaissance in the visible range, in the (near and far) IR range (IR=infrared), and, preferably, in the radar range. In principle, camouflage layers that satisfy these requirements more or less adequately have long been known in the art.

In order to realize a good camouflage coating, the camouflage effect must extend to include the entire wave range that is sensor detectable. In the infrared range it is crucial, in particular, to take into consideration the spectral range that includes the atmospheric windows II (3–5 $\mu$m) and III (8–14 $\mu$m) (compare, e.g., Electro-Optics Handbook, Technical Series EOH-11, RCA Corporation, 1974, p. 91, sec. 2).

A camouflage coating with wide band effectiveness extending from the visible range to at least the IR spectral range is known in the art from GB-565.238. The camouflage effect is achieved because an upper coating, which is responsible for preventing detection in the visible range, is modeled in such a way that it is transparent for infrared radiation, and that a foundation layer underneath the upper coating reflects infrared radiation in the desired fashion.

Thus, the known coating consists of a foundation and a camouflage color (pigment layer), which is applied on top of the former, and has reflecting properties in the visible range that are just like the normal background (e.g. chlorophyll). The foundation reflects in the range of terrestrial thermic radiation, while the cover layer is transparent for precisely that spectral range. Therefore, the pigment layer must use a bonding agent which provides good transparency in the spectral ranges of the atmospheric windows II and III.

DE-PS 977 526 reveals a camouflage structure that is effective for visible light, infrared, and radar location finding. To camouflage in the radar range, a camouflage net is equipped with an electrically conductive sub-layer (foundation). Suitable for use are either a metal lacquer (metallic color) or a metal foil that is glued on. In any case, the foundation is modeled to exhibit good reflective properties in the relevant wave range. Consequently, the homogeneous, metallic foundation (due to the low surface resistance of at most a few Ohms) reflects well in the radar range. Layers that scatter and absorb are applied onto the foundation. Preferably, a camouflage color effective in the visible range is applied as an outer layer and in a manner known in the art.

Another camouflage coating is known in the art from DE 725 253. For optimal camouflage, extending to include the visible and the long-wave range, it is proposed here to apply a sub-layer with reflective properties in the long-wave range underneath the visible camouflage coating (compare, e.g. page 2, lines 19–32); such a layer can be a metal foil (compare page 2, example 4), or a metallic paint (compare page 2, lines 33–43). Aluminum foil has (due to its homogenous metallic coating) excellent conductivity, i.e. a strong reflecting effect with respect to electromagnetic radiation in the radar range. Thus, the coating, which is known in the art, is modeled in such a way that it is automatically reflective in the radar range as well.

To improve camouflaging in the radar range, it is possible to use foils with slots (compare e.g. U.S. Pat. No. 3,069,796 or DE 1,088,843).

Later attempts to realize improved camouflaging (compare, e.g., EP 0 058 210 Pusch) have essentially failed to improve on the technical principles of the state of the art described above. Consequently, there remains a need for reconnaissance-resistant camouflage agents.

SUMMARY OF THE INVENTION

The object of the invention is to describe a camouflage structure that, in terms of reconnaissance-resistance in the IR range, will maintain its effectiveness even with changing temperatures (day/night, sunshine/clouds).

The invention is a camouflage structure including a first layer reflecting in the IR range with an emissivity which has a different course in the atmospheric windows II (3–5 $\mu$m) and III (8–14 $\mu$m), wherein the emissivity in the atmospheric window II has a falling tendency with increasing wave length. According to the invention, in atmospheric windows II and III, respectively, the camouflage structure shows different tendencies in terms of emissivity. In other words, the emissivity in the IR range is not constant and located on a certain level, but there is an increasing or a decreasing tendency of emissivity in at least one spectral range. Of particular importance are, in this context, the atmospheric windows II and III.

The camouflage structure according to the invention emulates the thermal characteristics (i.e. the black body spectrum) of the ground in the presence of sunshine and clouds. Indeed, there is an essential difference between this camouflage structure according to the invention and camouflage structures that assume the temperature (or the IR spectrum) of the layer of air near the ground. In fact, temperature developments in relation to the ground are essentially different, in particular under clear skies, in contrast to those in relation to the air. Moreover, the temperature distribution of the air is considerably narrower than that of the ground. Therefore, adjusting camouflage structures to the air temperature will, in general, produce inferior results in terms of anti-detection quality in comparison to adjusting camouflage structures to the ground temperature.

Of particular importance for the camouflage structure according to the invention is the realization that the zenith temperature is a determining factor with regard the ground temperature, or with regard to emulating that ground temperature. The quality of the camouflage depends on how the zenith temperature is reflected. In particular, the spectral qualities of the atmosphere and of the solar radiation must be taken into account. However, in the IR range, these factors are not constant but depend on the wavelength. Thus, fundamentally, it is understood that a camouflage structure must be adapted in terms of the spectrum. This means, if the camouflage structure's effectiveness is to exceed the current state of the art, it is important to suitably account for the prevailing conditions by corresponding adjustments with respect to the emissivity tendencies.

Experiments have shown that it is particularly advantageous if the emissivity shows a decreasing tendency in the atmospheric window II. Thus, the emissivity is chosen accordingly to ensure that—in the context of the window II referred to above—the emissivity is higher with smaller wavelengths than with larger wavelengths. The advantageous effect of this measure also relies, in particular, on the fact that the black body spectrum of the sun decreases by approximately one decade in the range of 3–5 $\mu$m. However, it is not necessary for the emissivity of the camouflage structure to decrease at the same rate. It suffices if the emissivity follows this tendency.

Good results are achieved if the emissivity in the upper wave range of the atmospheric window II is at least 25%, but preferably around 50%, lower than in the lower wave range of said atmospheric window II. This minimizes any undesired luster effect of the camouflage coating (the luster effect that does not correspond to the natural or real background).

In the atmospheric window III (in particular, in the range of 8–14 $\mu$m) the spectral emissivity should be slightly reduced. The tendency can be constant. In that sense, the value of the relative emissivity can range between 0.7–0.9 (e.g., approximately 0.8).

At night the camouflage effect can be compromised if the tendentially low zenith temperature is reflected too much, which, in terms of reconnaissance, is read as a "black hole."

In the wave range between the windows II and III (where the atmosphere is impermeable for IR radiation) the emissivity should be as high as possible. It is advantageous if the emissivity is higher than that in the atmospheric window III.

The camouflage structure according to the invention consists of at least two layers. The lower layer reflects in the IR range. The upper layer essentially consists of a material that is transparent in the atmospheric window II, but not in the window III.

The upper layer is, for example, a pigment coating, that is responsible for camouflaging in the visible range. The transparent material of the outer layer referred to above, which is only transparent for parts of the spectral range, consists essentially of the (color pigment enveloping) bonding agent (a plastic carrier or matrix).

The lower layer (foundation) referred to above is metallic. In this context, aluminum is mentioned as a preferred example. The foundation can be modeled as a metal foil, or as a vaporized or sprayed-on layer that is applied onto a carrier material.

According to an especially preferred embodied example, the border area of the foundation layer, which is directed toward the upper layer, has a three-dimensional texture. This causes the emissivity of the camouflage structure to decrease in the atmospheric window II when the wavelength increases. The referred-to three-dimensional texture can be produced, for example, if a carrier consists of a fibrous material (cloth) that is metallically coated. However, it is also possible to use a metal foil (or a foil that is coated with metal) with a finely stamped surface. Another possibility is the use of a brushed aluminum sheet as the sub-layer, for example.

It may also be advantageous to incorporate scattering bodies into the camouflage structure that create diffuse scattering of incoming radiation in the range of 3–5 $\mu$m. In fact, in this range, depending on the incoming radiation, smooth metal surfaces can create strong unnatural reflexes, thereby possibly causing detection of the camouflage. Dulling agents with a suitable grain size, known in the art, can serve as scattering bodies.

In practical application, there are frequent demands for a multi-spectral camouflage. This means it is not sufficient to ensure camouflaging in the IR range, but radar detection must also be prevented simultaneously. Good camouflaging in the radar range can be achieved, on the one hand, by selecting a suitable resistance for the metal coating, and, on the other hand, by shaping the camouflage area to have three dimensions.

The resistance in the radar range must be selected in such a way that a portion of the radar waves is absorbed. Practical applications have shown that the resistance (independent from the wavelength) is preferably in a range of 30–300 Ohm. The resistance can be adjusted by the respective selections of the layer thickness and of the layer material, as well as with localized perforations (holes). Instead of damping the electrical field, damping of the magnetic field of a radar wave is also possible (e.g., by depositing a magnetic layer).

To create a three-dimensional construct, a leaf-cut (e.g., of the type that is known in the art from U.S. Pat. No. 3,069,796 or DE 1.088.843) can be applied to a fabric or to a laminate. Incidentally, this measure has also an advantageous effect in the IR range because it contributes to the zenith temperature being reflected into varying directions.

Based on the following detail descriptions and the totality of the patent claims, other advantageous embodied examples and combinations of characteristics will emerge.

BRIEF DESCRIPTION OF THE DRAWINGS

The drawings for the purpose of explaining the embodiment show the following.

As a rule, identical parts in the figures are assigned identical designations.

DETAILED DESCRIPTION OF THE PREFERRED EMBODIMENTS

Figure 1:
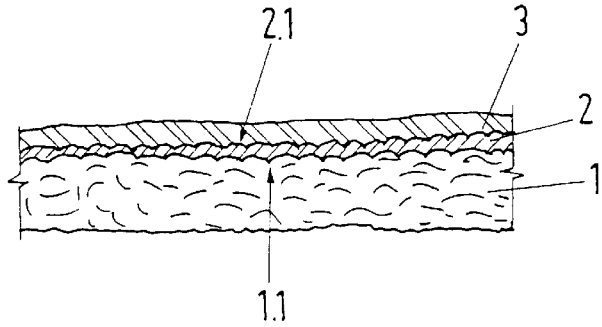
FIG. 1 A schematic depiction of a camouflage structure with a fabric as carrier material.

FIG. 1 shows a cross-section of the camouflage structure according to the invention. Fibrous fabric 1 is used as a carrier. Not only is this type of fabric sturdy and resistant to tearing, but it also features (in the micrometer range) a three-dimensionally textured surface 1.1. In principle, the surface 1.1. consists of a multitude of fine, more or less cylindric fibers (consisting of polyester or a similar material), which lie closely together and on top of each other. This creates a three-dimensionality that is able to generate a scattering effect for infrared radiation in the range of 3–5 $\mu$m as described in the following.

The surface 1.1 is covered with a metal coating 2. This coating can be applied by spraying, vaporizing or even painting. According to a particularly preferred embodied example, the coating not only serves to reflect (or scatter) infrared radiation, but it is also a camouflage in the radar range. The related necessary adjustments with regard to conductivity are accomplished, on the one hand, by selecting a suitable material, and on the other hand, (in particular) by determining the layer thickness. The surface resistance in the radar wave frequency range is located, preferably, in the range of a few to a few hundred Ohms.

Due to the fact that the (normally very thin) metal coating 2 is applied to a carrier with a three-dimensionally textured surface 1.1, the former features on its outer side 2.1 a corresponding structure in the micrometer range.

On top there is an outer layer 3. Because this layer is intended to camouflage in the visible wave range (in the way that is known in the art), it is modeled as a pigment layer. Depending on the intended use of the camouflage, the pigment color is a grey or green shade The bonding agent (which is crucial for the characteristics of the outer layer 3 in the infrared range) of the pigment layer is, according to a preferred embodied example of the invention, transparent for wavelengths of 3–5 $\mu$m (atmospheric window II); however, it is not transparent for wavelengths of 8–14 $\mu$m (atmospheric window III).

The transparency of the outer layer 3 can be adjusted with the respective selection of the layer thickness. In fact, as a final consequence, if the outer layer 3 is sufficiently thin, a certain transparency (and consequently emissivity in the desired amount) can actually be achieved in the atmospheric window III.

Figure 2:
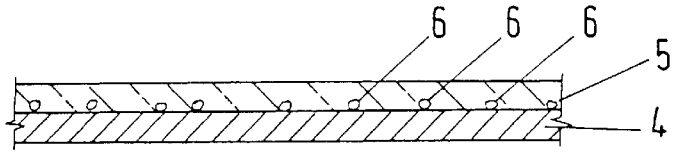
FIG. 2 A schematic depiction of a camouflage structure in the form of a laminate.

The camouflage structure according to the invention can also be modeled as a laminate. Such a laminate is shown, for example, in FIG. 2. The lower layer is a metal foil 4, which can be applied onto the carrier, which is not shown in the figure. Or it is possible that the foil itself can serve as carrier material. The foil is covered with an outer layer 5 which can be modeled like the outer layer described in FIG. 1.

To scatter the coming infrared radiation diffusely to the desired extent, scattering bodies 6 are incorporated in the outer layer 5 (or in the border area between metal foil 4 and outer layer 5). The scattering bodies are particles of a size which is at least in the range of the wavelength in question (3–5 $\mu$m), so that they can generate a scattering effect. In this context, it can be advantageous if the statistical distribution of the particle sizes is not too narrow (use of poly-dispersion dulling agents).

The layered structure according to the invention is particularly useful for camouflage nets. These are fabric-type or foil-type tarpaulins that can be positioned over the items to be protected from detection. To achieve good effectiveness in terms of evading radar reconnaissance, these camouflage nets should feature, preferably, a suitable leaf-cut. When the net is spread out, the cut-out leaves stand up and generate a diffuse scattering effect in the radar range.

Figure 3:
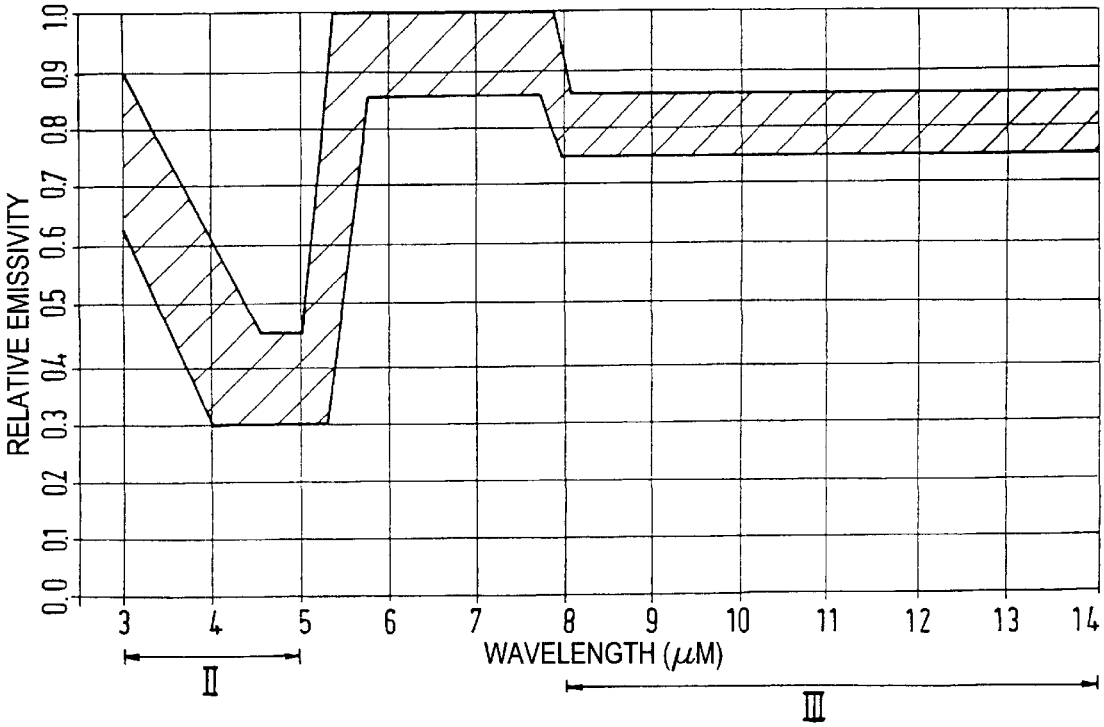
FIG. 3 A schematic depiction of the development of the spectral emissivity of the camouflage structure in accordance with the invention.

FIG. 3 is a demonstration of the factor $S=1-\rho$($\rho$= reflexivity), which in relation to grey bodies approximately corresponds to the relative emissivity ($E_r$); for a camouflage structure according to the invention depending on the wavelength ($\lambda$). At this time, we are only interested in the wave range of 3–14 $\mu$m, which represents the atmospheric windows II and III.

At the lower end of the window II (i.e. at about 3 $\mu$m), the emissivity is somewhat smaller than 1.0 (e.g., between 0.65 and 0.9).

The emissivity diminishes with increasing wavelength. In the current example, it falls to almost half of its original value, i.e. to 0.3–0.45. The steepness of the decrease is, for example, one octave per micrometer, in particular, approximately one decade per micrometer. FIG. 3 illustrates a small plateau in the range between 4 $\mu$m and 5 $\mu$m.

Starting at 5 $\mu$m, a strong increase toward a maximum level begins. Preferably, this level is at least as high as the emissivity in the atmospheric window III. In the present case, the maximum level is in the range of 0.85–1.0. In terms of its tendency, the course of the emissivity—after the level has reached the maximum—continues on the same level.

Inside the atmospheric window III, the emissivity should be reduced. In the current example, it is between 0.75 and 0.85. Also with this wave range the tendency of the emissivity course is constant (which means it does not increase or decrease).

FIG. 3 illustrates only one of many possibilities. In particular, in the range between the windows II and III, the emissivity does not necessarily have to climb to a maximum level. It is also possible, for example, that it climbs slowly and more or less continually to the level desired in window III. Since the atmosphere is impenetrable between 5 $\mu$ and 8 $\mu$m, the emissivity behavior at this wave range is not very critical for the quality of the camouflage effectiveness.

Although FIG. 3 shows a constant development in atmospheric window III, a decreasing or increasing tendency is also possible when the wavelength increases. Naturally, the development inside window II can exhibit a different tendency.

Obviously, a concrete measuring curve of a camouflage structure according to the invention will vary within certain limits. Minor modulations cannot be avoided. However, in terms of the invention, these are not greatly important. What is important is the overall development, i.e. the tendency of the curve.

On a camouflage net it is possible to unite areas with different camouflage structures (in a kind of patchwork arrangement). It is important to note here, however, that the emissivity conditions according to the invention cannot be satisfied by looking at a single point of the net, but only if the net is looked at as a whole (i.e. in consideration of a larger area).

Even though camouflage nets are the preferred application, it is also possible to realize the camouflage structure according to the invention on the surfaces of technical equipment housings or buildings.

In summary, it can be concluded that this invention creates a camouflage structure that is able to realize camouflaging effectiveness, and is optimally adjusted to concrete conditions, on the basis of emissivity that depends on wavelength.

What is claimed is:

1. A camouflage structure comprising:

a first layer reflecting in the IR range with an emissivity which has a different course in the atmospheric windows II (3–5 $\mu$m) and III (8–14 $\mu$m), wherein the emissivity in the atmospheric window II has a falling tendency with increasing wave length.

2. The camouflage structure according to claim 1, wherein the emissivity in the atmospheric window II (3–5 $\mu$m) drops by at least 25%.

3. The camouflage structure according to claim 1, wherein the emissivity in atmospheric window III (8–14 $\mu$m) tends to be constant and lies in a range from 0.7 to 0.9.

4. The camouflage structure according to claim 1, wherein the emissivity in the wave length range between atmospheric windows II and III is at least as high as an atmospheric window III (8–14 $\mu$m).

5. The camouflage structure according to claim 1, further comprising:

an upper, second layer above the first layer, the second layer including a material which is transparent in atmospheric window II (3–5 $\mu$m), but not in atmospheric window III (8–14 $\mu$m).

6. The camouflage structure according to claim 1, wherein the first layer includes a metal.

7. The camouflage structure according to claim 1, further comprising:

an upper boundary layer of the first layer structured in three dimensions so that the emissivity in the atmospheric window II (3–5 $\mu$m) diminishes with increasing wave length.

8. The camouflage structure according to claim 5, further comprising:

scattering elements embedded in the second layer, or between the second and the first layers, in order to bring about a diffuse scattering of incident infrared radiation, including in the 3–5 $\mu$m range.

9. The camouflage structure according to claim 1, further comprising:

a pigment layer for camouflage in the visible range as a cover layer.

10. A camouflage network comprising: a camouflage structure with a layer reflecting in the IR range with an emissivity which has a different course in atmospheric windows II (3–5 $\mu$m) and III (8–14 $\mu$m), wherein the emissivity in atmospheric window II has a falling tendency with increasing wave length.

11. A camouflage network according to claim 10, wherein the camouflage network is constructed as a laminated or a coated tissue.

12. The camouflage network according to claim 10, further comprising:

a leaf-cut for camouflage in the radar range.

13. The camouflage structure according to claim 1, wherein the first layer includes aluminum.

14. The camouflage structure according to claim 1, wherein the emissivity in the atmospheric window II (3–5 $\mu$m) drops by at least 50%.

* * * * *